US011474444B2

(12) United States Patent
Kubo

(10) Patent No.: US 11,474,444 B2
(45) Date of Patent: Oct. 18, 2022

(54) INTERMEDIATE TRANSFER BELT AND IMAGE FORMING APPARATUS

(71) Applicant: Hidetaka Kubo, Kanagawa (JP)

(72) Inventor: Hidetaka Kubo, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/568,749

(22) Filed: Jan. 5, 2022

(65) Prior Publication Data

US 2022/0221806 A1 Jul. 14, 2022

(30) Foreign Application Priority Data

Jan. 8, 2021 (JP) ..... JP2021-002188
Mar. 5, 2021 (JP) ..... JP2021-035505

(51) Int. Cl.
*G03G 15/16* (2006.01)
*G03G 15/01* (2006.01)

(52) U.S. Cl.
CPC ..... *G03G 15/0189* (2013.01); *G03G 15/162* (2013.01); *G03G 15/1615* (2013.01)

(58) Field of Classification Search
CPC ..... G03G 15/0189; G03G 15/1605; G03G 15/162; G03G 15/1625
USPC ..... 399/298, 299, 302, 308
See application file for complete search history.

(56) References Cited

U.S. PATENT DOCUMENTS

| | | | | |
|---|---|---|---|---|
| 9,005,749 | B2 * | 4/2015 | Coggan et al. ..... | G03G 15/162 428/323 |
| 9,063,475 | B2 * | 6/2015 | Aoto et al. ..... | G03G 15/162 |
| 11,042,107 | B2 * | 6/2021 | Kubo et al. ..... | G03G 15/162 |
| 11,340,540 | B2 * | 5/2022 | Takei et al. ..... | G03G 15/162 |
| 2017/0269513 | A1 | 9/2017 | Kubo et al. | |
| 2018/0267435 | A1 | 9/2018 | Kubo | |
| 2019/0227463 | A1 | 7/2019 | Kubo et al. | |
| 2020/0285173 | A1 | 9/2020 | Ohmori et al. | |

FOREIGN PATENT DOCUMENTS

| | | |
|---|---|---|
| JP | 9-230717 | 9/1997 |
| JP | 2002-162767 | 6/2002 |
| JP | 2002-356654 | 12/2002 |
| JP | 2004-354716 | 12/2004 |
| JP | 2007-254558 | 10/2007 |
| JP | 2007-328165 | 12/2007 |
| JP | 2008-050234 | 3/2008 |
| JP | 2009-075154 | 4/2009 |
| JP | 2012-083626 | 4/2012 |
| JP | 2012-189724 | 10/2012 |
| JP | 2014-126788 | 7/2014 |
| JP | 2015-114595 | 6/2015 |
| JP | 2015-148660 | 8/2015 |
| JP | 5798240 | 10/2015 |

* cited by examiner

*Primary Examiner* — William J Royer
(74) *Attorney, Agent, or Firm* — Xsensus LLP

(57) ABSTRACT

An intermediate transfer belt is provided. The intermediate transfer belt includes a base layer, an elastic layer over the base layer, and a surface layer over the elastic layer. The elastic layer contains spherical particles and has an uneven surface formed by the spherical particles. The surface layer contains at least one of antimony-doped tin oxide or indium tin oxide.

7 Claims, 6 Drawing Sheets

INTERMEDIATE TRANSFER BELT AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2021-002188 and 2021-035505, filed on Jan. 8, 2021 and Mar. 5, 2021, respectively, in the Japan Patent Office, the entire disclosure of each of which is hereby incorporated by reference herein.

BACKGROUND

Technical Field

The present disclosure relates to an intermediate transfer belt and an image forming apparatus.

Description of the Related Art

In conventional electrophotographic apparatuses, a seamless belt has been used as a member in various applications. In particular, recent full-color electrophotographic apparatuses employ an intermediate transfer belt system in which four developed images of yellow, magenta, cyan, and black are temporarily superimposed on an intermediate transfer medium and then collectively transferred onto a transfer medium such as a paper sheet.

The intermediate transfer belt system has been employed in an apparatus equipped with one photoconductor and four developing devices (corresponding to four colors), but has a drawback that the printing speed is slow. For this reason, in a high-speed printer, a quadruple tandem system is employed in which four photoconductors (corresponding to four colors) are arranged in tandem. This system makes each color toner image continuously transferred onto paper. However, it is very difficult with this system to superimpose the four color images with high positional accuracy due to fluctuations of the condition of paper caused by the environment, resulting in an image out of color registration. In view of this situation, it is becoming mainstream to combine the quadruple tandem system with the intermediate transfer belt system.

SUMMARY

In accordance with some embodiments of the present invention, an intermediate transfer belt is provided. The intermediate transfer belt comprises a base layer, an elastic layer over the base layer, and a surface layer over the elastic layer. The elastic layer contains spherical particles and has an uneven surface formed by the spherical particles. The surface layer contains at least one of antimony-doped tin oxide or indium tin oxide.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
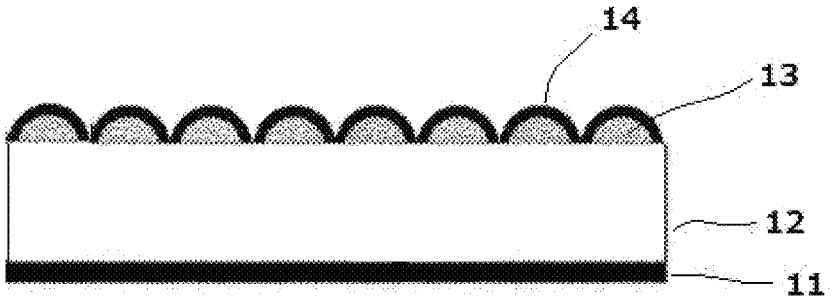
FIG. 1 is a schematic cross-sectional diagram illustrating a layer structure of an intermediate transfer belt according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

The intermediate transfer belt is required to meet demands for high-speed transfer and high positional accuracy that are more severe than conventional ones. In particular, with respect to positional accuracy, the intermediate transfer belt is required to reduce fluctuations caused by deformation (e.g., elongation) of the belt itself due to continuous use. In addition, the intermediate transfer belt is required to be flame-retardant since it is laid over a wide area of the apparatus and a high voltage is applied thereto in transferring images. To meet such demands, the intermediate transfer belt is mainly composed of a material such as polyimide resin and polyamideimide resin, each of which has high elastic modulus and high heat resistant.

However, the intermediate transfer belt made of polyimide resin has a high surface hardness because of its high strength, and applies a high pressure to a toner layer of a toner image when transferring the toner image. As a result, the toner is locally agglomerated and a part of the toner image is not transferred, generating a defective image with voids. In addition, such an intermediate transfer belt exhibits poor followability with respect to a member (e.g., photoconductor, paper sheet) which comes into contact at a transfer portion. As a result, defective contact portions (i.e., voids) are partially generated in the transfer portion, causing transfer unevenness.

In recent years, full-color electrophotographic images have been often formed on various types of paper. Not only normal smooth paper but also slippery smooth paper (e.g., coated paper) and rough-surface paper (e.g., recycled paper, embossed paper, Japanese paper, kraft paper) are increasingly used. The intermediate transfer belt needs to exhibit variations of followability according to the surface property of paper. Poor followability causes unevenness in density and color tone corresponding to the unevenness of the paper. In attempting to solve this problem, an intermediate transfer belt has been proposed in which a relatively flexible rubber elastic layer is laminated on a base layer.

There has been a proposal to provide a protective layer on the intermediate transfer belt with a material having sufficiently high transfer performance. However, it is impossible for such a material to follow flexibility of the intermediate transfer belt, thus undesirably causing cracking and peeling. As another approach, there has been a proposal to improve transfer performance by adhering fine particles to the surface of the intermediate transfer belt.

In accordance with some embodiments of the present invention, an intermediate transfer belt is provided that has excellent transfer performance onto paper having surface unevenness, prevents detachment of particles over an extended period of time, and has high durability.

Embodiments of the present invention are described in detail below.

A conventional intermediate transfer belt contains an insulating material on its surface and is generally low in toner transfer performance. Particles contained in the intermediate transfer belt are likely to be detached as sheets (particularly, edge portions of the sheets) pass on the intermediate transfer belt. As a result, the toner transfer performance at the particle-detached portion is further reduced, and an image with white streaky voids are formed on the belt. As described above, some embodiments of the present invention provide an intermediate transfer belt that has excellent transfer performance onto paper having surface unevenness, prevents detachment of particles over an extended period of time, and has high durability.

In an electrophotographic apparatus, seamless belts are used for several members. One of major members which requires electrical characteristics is an intermediate transferor (e.g., intermediate transfer belt). The intermediate transfer belt according to an embodiment of the present invention is described in detail below.

The intermediate transfer belt according to an embodiment of the present invention is suitably equipped in an electrophotographic apparatus. In the electrophotographic apparatus, multiple color toner images are sequentially formed on an image bearer (e.g., photoconductor drum) and primarily transferred and superimposed on one another on the intermediate transfer belt in a sequential manner to form a primary transfer image, and the primary transfer image is secondarily transferred onto a recording medium in a collective manner.

FIG. 1 is a schematic cross-sectional diagram illustrating a layer structure of an intermediate transfer belt according to an embodiment of the present invention. On a base layer 11 that is rigid and relatively flexible, an elastic layer 12 having flexibility is laminated. Spherical particles 13 are independently embedded in the outermost surface of the elastic layer 12 and aligned in a plane direction of the elastic layer 12, thus uniformly forming an uneven surface. The spherical particles 13 are present independent from each other. There is almost no overlap of the spherical particles 13 in the thickness direction of the layer. There is almost no complete embedment of the spherical particles 13 in the elastic layer 12. Over the elastic layer 12, a surface layer 14 is laminated.

Base Layer

The base layer 11 is described in detail below. The base layer 11 may comprise a resin containing an electrical resistance adjusting material, e.g., a filler or additive that adjusts electrical resistance.

Preferred examples of such a resin in terms of flame retardancy include, but are not limited to, fluorine-based resins such as polyvinylidene fluoride (PVDF) and ethylene tetrafluoroethylene (ETFE), polyimide resins, and polyamideimide resins. Preferred examples of such a resin in terms of mechanical strength (i.e., high elasticity) and heat resistance include, but are not limited to, polyimide resins and polyamideimide resins.

Examples of the electrical resistance adjusting material include, but are not limited to, metal oxides, carbon blacks, ion conducting agents, and conductive polymer materials. Specific examples of the metal oxides include, but are not limited to, zinc oxide, tin oxide, titanium oxide, zirconium oxide, aluminum oxide, and silicon oxide. These metal oxides may have been surface-treated to improve dispersibility. Specific examples of the carbon blacks include, but are not limited to, Ketjen black, furnace black, acetylene black, thermal black, and gas black. Specific examples of the ion conducting agents include, but are not limited to, tetraalkylammonium salts, trialkylbenzylammonium salts, alkyl sulfonates, alkylbenzene sulfonates, alkyl sulfates, glycerin fatty acid esters, sorbitan fatty acid esters, polyoxyethylene alkylamines, polyoxyethylene aliphatic alcohol esters, alkyl betaine, lithium perchlorate, and combinations thereof.

The electrical resistance adjusting material is not limited to the above-exemplified compounds.

A coating liquid used for manufacturing the intermediate transfer belt according to an embodiment of the present invention contains at least a resin component and further optionally contains additives such as a dispersing auxiliary agent, a reinforcing material, a lubricant, a thermal conduction material, and an antioxidant, if necessary.

A seamless belt suitably used as the intermediate transfer belt preferably contains carbon black in an amount such that the surface resistivity and volume resistivity thereof become $1\times10^{8}$ to $1\times10^{13}\Omega/\square$ and $1\times10^{8}$ to $1\times10^{11}$ $\Omega\cdot$cm, respectively. In addition, the addition amount of the carbon black is determined such that the resulting layer does not become brittle and fragile in terms of mechanical strength. Such a seamless belt is preferably manufactured using a coating liquid in which the resin component (e.g., polyimide resin precursor, polyamideimide resin precursor) and the electrical resistance adjusting material are blended at an appropriate ratio to achieve a good balance between electric characteristics (i.e., surface resistivity and volume resistivity) and mechanical strength.

The thickness of the base layer 11 is not particularly limited and can be suitably selected to suit to a particular application, but is preferably from 30 to 150 μm, more preferably from 40 to 120 μm, and particularly preferably from 50 to 80 μm. When the thickness of the base layer 11 is more than 30 μm, the belt is prevented from being torn by cracking. When the thickness is 150 μm or less, the belt is prevented from being cracked by bending. The base layer 11 having a thickness within the above-described particularly preferable range is advantageous in terms of durability. It is preferable to eliminate unevenness in film thickness of the base layer 11 as much as possible to improve running stability.

The method for measuring the thickness of the base layer 11 is not particularly limited. For example, the thickness may be measured using a contact-type or eddy-current-type film thickness meter or from a cross-sectional image of the base layer obtained by a scanning electron microscope (SEM).

In a case in which the electrical resistance adjusting material is carbon black, the proportion thereof to total solid contents in the coating liquid is from 10% to 25% by weight, preferably from 15% to 20% by weight. In a case in which the electrical resistance adjusting material is a metal oxide, the proportion thereof to total solid contents in the coating liquid is from 1% to 50% by weight, preferably from 10% to 30% by weight. When the proportion of the electrical resistance adjusting material is within the above-described range, the resistance values become uniform and are prevented from fluctuating in response to a certain potential. Further, the mechanical strength of the intermediate transfer belt is improved, which is preferred for practical use.

The polyimide and polyamideimide resins described above are available as general-purpose products from manufacturers such as DU PONT-TORAY CO., LTD., Ube Industries, Ltd., New Japan Chemical Co., Ltd., JSR Corporation, UNITIKA LTD., I.S.T. Corporation, Hitachi Chemical Company, Ltd., TOYOBO CO., LTD., and ARAKAWA CHEMICAL INDUSTRIES, LTD.

Elastic Layer

Next, the elastic layer 12 overlying the base layer 11 is described in detail below. The elastic layer 12 may comprise a general-purpose resin, elastomer, and/or rubber. Preferably, the elastic layer 12 comprises a material having sufficient flexibility or elasticity to fully exhibit the effect of the present embodiment, such as an elastomer material or a rubber material.

Examples of the elastomer material include, but are not limited to, thermoplastic elastomers of polyester-based, polyamide-based, polyether-based, polyurethane-based, polyolefin-based, polystyrene-based, polyacrylic-based, polydiene-based, silicone-modified-polycarbonate-based, and fluoro-copolymer-based. Examples of the elastomer material further include thermosetting elastomers of polyurethane-based, silicone-modified-epoxy-based, and silicone-modified-acrylic-based.

Examples of the rubber material include, but are not limited to, isoprene rubber, styrene rubber, butadiene rubber, nitrile rubber, ethylene propylene rubber, butyl rubber, silicone rubber, chloroprene rubber, acrylic rubber, chlorosulfonated polyethylene, fluororubber, urethane rubber, and hydrin rubber.

From among the various elastomers and rubbers described above, those which can achieve a desired performance are suitably selected. In view of ozone resistance, flexibility, adhesion to spherical particles, flame retardancy, and environmental stability, acrylic rubber is most preferred in the present embodiment. Details of the acrylic rubber is described below.

The acrylic rubber used for the elastic layer 12 may be those available from the market and is not particularly limited. Among various types of cross-linked acrylic rubbers (e.g., epoxy-group-based, active-chlorine-group-based, carboxyl-group-based), carboxyl-group-based cross-linked rubbers are preferred for their excellent rubber properties (in particular, compression set) and processability thereof.

A cross-linking agent used for the carboxyl-group-based cross-linked acrylic rubber is preferably an amine compound, and most preferably a polyvalent amine compound. Examples of the amine compound include, but are not limited to, aliphatic polyvalent amine cross-linking agents and aromatic polyvalent amine cross-linking agents. Specific examples of the aliphatic polyvalent amine cross-linking agents include, but are not limited to, hexamethylenediamine, hexamethylenediamine carbamate, and N,N'-dicinnamylidene-1,6-hexanediamine. Specific examples of the aromatic polyvalent amine cross-linking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene)dianiline, 4,4'-(p-phenylenediisopropylidene)dianiline, 2,2'-bis[4-(4-aminophenoxy)phenyl]propane, 4,4'-diaminobenzanilide, 4,4'-bis(4-aminophenoxy)biphenyl, m-xylylenediamine, p-xylylenediamine, 1,3,5-benzenetriamine, and 1,3,5-benzenetriaminomethyl.

The amount of the cross-linking agent to be blended with 100 parts by mass of the acrylic rubber is preferably from 0.05 to 20 parts by mass, more preferably from 0.1 to 5 parts by mass. When the blending amount of the cross-linking agent is 0.05 parts by mass or more, cross-linking is sufficiently performed, and the shape of the cross-linked product is favorably maintained. When the blending amount is 20 parts by mass or less, the cross-linked product does not become too hard, and the elasticity becomes good as a cross-linked rubber.

In preparing the elastic layer 12, a cross-linking accelerator may be further blended in combination with the cross-linking agent. The cross-linking accelerator is also not particularly limited as long as it can be used in combination with the polyvalent amine cross-linking agent. Examples of such a cross-linking accelerator include, but are not limited to, guanidine compounds, imidazole compounds, quaternary onium salts, tertiary phosphine compounds, and alkali metal salts of weak acids. Specific examples of the guanidine compounds include, but are not limited to, 1,3-diphenylguanidine and 1,3-diorthotolylguanidine. Specific examples of the imidazole compounds include, but are not limited to, 2-methylimidazole and 2-phenylimidazole. Specific examples of the quaternary onium salts include, but are not limited to, tetra n-butyl ammonium bromide and octadecyl tri-n-butyl ammonium bromide. Specific examples of the polyvalent tertiary amine compounds include, but are not limited to, triethylenediamine and 1,8-diaza-bicyclo[5.4.0]undecene-7 (DBU). Specific examples of the tertiary phosphine compounds include, but are not limited to, triphenylphosphine and tri-p-tolylphosphine. Specific examples of the alkali metal salts of weak acids include, but are not limited to, inorganic weak acid salts (e.g., phosphate, carbonate) and organic weak acid salts (e.g., stearate, laurate) of sodium or potassium.

The amount of the cross-linking accelerator used for 100 parts by mass of the acrylic rubber is preferably from 0.1 to 20 parts by mass, more preferably from 0.3 to 10 parts by mass. When the blending amount of the cross-linking accelerator is 20 parts by mass or less, the cross-linking rate becomes appropriate at the time of cross-linking, and the cross-linking accelerator is prevented from blooming to the surface of the cross-linked product and the cross-linked product is prevented from becoming too hard. When the blending amount of the cross-linking accelerator is 0.1 parts by mass or more, the tensile strength of the cross-linked product becomes appropriate, and an elongation change or tensile strength change after thermal loading can be reduced.

In preparing the acrylic rubber, an appropriate mixing method can be employed, such as roll mixing, Banbury mixing, screw mixing, and solution mixing. There is no particular limitation on the order of blending of components. Preferably, components which hardly react or decompose by heat are sufficiently mixed first, and components (e.g., cross-linking agent) which easily react or decompose by heat are thereafter mixed in a short time at a temperature at which any reaction or decomposition does not occur.

The acrylic rubber can be made into a cross-linked product by heating. The heating temperature is preferably from 130° C. to 220° C., more preferably from 140° C. to 200° C. The cross-linking time is preferably from 30 seconds to 5 hours. The heating method may be suitably selected from known methods used for cross-linking rubbers, such as press heating, steam heating, oven heating, and hot air heating. Also, post-cross-linking may be performed after the cross-linking in order to complete cross-linking even inside the cross-linked product. The post-cross-linking is preferably performed for 1 to 48 hours, but the time varies depending on the heating method, cross-linking temperature, and shape. The heating method and heating temperature in the post-cross-linking may be appropriately selected.

As to flexibility of the elastic layer 12, it is preferable that a micro rubber hardness thereof is from 30 to 80 at 25° C., 50% RH. The micro rubber hardness can be measured by a commercially-available micro rubber durometer such as Micro Durometer MD-1, product of Kobunshi Keiki Co., Ltd.

The film thickness of the elastic layer 12 is preferably from 200 to 600 μm, more preferably from 300 to 400 μm. When the film thickness is 200 μm or more, the quality of images formed on paper sheets having surface unevenness becomes good. When the film thickness is 600 μm or less, the weight of the elastic layer 12 becomes appropriate, and the elastic layer 12 is prevented from deflecting or warping, stabilizing running properties. The film thickness can be measured from a cross-section of the layer obtained with a scanning electron microscope (SEM).

Spherical Particles

Figure 2:
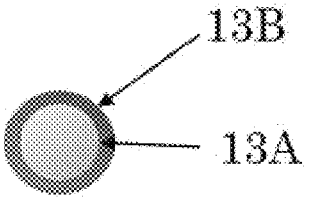
FIG. 2 is a diagram illustrating an insulating resin particle coated with a conductive resin.

Next, spherical particles disposed at the surface of the elastic layer 12 are described in detail below. The material of the spherical particles is not particularly limited, and insulating resin particles may be used alone therefor. Examples of the spherical particles further include: insulating resin particles 13A illustrated in FIG. 2 whose surfaces are coated with a conductive polymer 13B such as polypyrrole or polythiophene (as disclosed in, for example, Japanese Unexamined Patent Application Publication No. 2007-254558 and Japanese Unexamined Patent Application Publication No. 2002-356654); and multilayered insulating resin particles whose surfaces are metal-plated to form a plating layer to increase conductivity. For improving transfer performance, polypyrrole is preferred. For preventing detachment of the particles, insulating resin particles whose surfaces are metal-plated are preferred. As to conductivity of the spherical particles, the volume resistivity thereof is preferably from $1\times10^4$ to $1\times10^{11}$ Ω·cm, and particularly preferably from $1\times10^6$ to $1\times10^{10}$ Ω·cm. The resistance of the spherical particles can be measured using instruments MCP-PD51 and LORESTA GP (or HIRESTA in the case of high resistance), both products of Mitsubishi Chemical Analytech Co., Ltd. Here, the spherical particles refer to particles having a true spherical shape (to be described later) with an average particle diameter of 100 μm or less. The average particle diameter of the spherical particles is not particularly limited as long as the particles can be packed such that toner does not enter the interstices between the particles. Preferably, the particle diameter is from 0.5 to 5 μm, more preferably from 1 to 2 μm.

As an example, a method for coating the surfaces of the spherical particles with a metal to form a metal layer thereon is described below. The spherical particles may be composed of, for example, acrylic resin (e.g., polymethyl methacrylate, polymethyl acrylate), polyolefin resin (e.g., polyethylene, polypropylene, polyisobutylene, polybutadiene), polystyrene resin, melamine resin, or silica. The metal for coating the spherical particles may be, for example, gold, silver, copper, platinum, zinc, iron, palladium, nickel, tin, chromium, titanium, aluminum, cobalt, germanium, cadmium, or a metal compound such as indium tin oxide (ITO) and solder. The metal layer may have either a single layer structure or a laminated structure including multiple layers. Among the above-described materials, nickel, silver, and gold are preferred because they are easy to be plated, and nickel is particularly preferred for its inexpensiveness and excellent adhesion to rubber. The coating material may be either a simple substance of a metal or an alloy of a plurality of the above-described materials.

The surfaces of the spherical particles may be coated with a metal by a known method, such as electroless plating, substitution plating, electroplating, or sputtering. Among these methods, electroless plating is particularly preferred for its easiness in controlling the thickness of the metal layer. The thickness of the metal layer is not particularly limited, but is preferably from 1 to 100 nm, more preferably from 5 to 20 nm. When the thickness of the metal layer is 100 nm or less, the specific gravities of the spherical particles become appropriate, the embedding ratio of the spherical particles into rubber becomes good, and the transfer performance gets improved. When the thickness of the metal layer is 1 nm or more, the adhesion to rubber gets improved. Such spherical particles having conductivity are available as products from, for example, Mitsubishi Materials Corporation, NIPPON CHEMICAL INDUSTRIAL CO., LTD., Teikokuion CO., LTD, or Toyo Aluminum K.K.

Measurement of Volume Resistivity of Spherical Particles

The volume resistivity of the spherical particles may be measured as follows. First, 1 g of the particles is placed in a pressure container having a diameter of 15 mm and applied with a load of 20 KN in an environment of 23° C., 50% RH. The volume resistivity is calculated from the value read at 90 V (or 10 V in the case of using HIRESTA UP). The volume resistivity of the spherical particles is preferably from $1\times10^4$ to $1\times10^{11}$ Ω·cm. The volume resistivity of the spherical particles can be adjusted to be within this preferred range by changing the plating thickness of the metal layer. (The thinner the coating, the higher the volume resistivity. The thicker the coating, the lower the volume resistivity.)

If only a material having too high conductivity, such as a metal or a conductive polymer, is used for the spherical particles, the volume resistivity of the particles is too low to fall within the preferred range. Thus, particles having a multilayer structure as described above is preferred.

Surface Layer

The surface layer 14 contains antimony-doped tin oxide or indium tin oxide (ITO).

Antimony-doped tin oxide is a tin oxide containing a small amount of antimony oxide. One of typical production methods thereof is a co-precipitation firing method using a hydrolyzable tin compound and an antimony compound as raw materials. In this method, the tin compound and the antimony compound are simultaneously subjected to hydrolysis in the same solution to cause co-precipitation of hydrated oxides of tin and antimony. Antimony-doped tin oxide has better wear resistance than conducting agents such as carbon black since it is a metal. Antimony-doped tin oxide may be produced by known methods (for example, see Japanese Patent No. 5798240), or general-purpose products available from Mitsubishi Materials Corporation and MITSUI MINING & SMELTING CO., LTD. may be used.

Indium tin oxide (ITO) is a composite oxide of indium oxide ($In_2O_3$) and tin oxide ($SnO_2$). Indium tin oxide (ITO) is generally produced by dissolving indium and tin with an acid to prepare an acidic aqueous solution containing indium and tin, and then precipitating a coprecipitated oxide of neutralized indium and tin with an alkaline aqueous solution, followed by calcination. Since indium tin oxide (ITO) is a metal, it has better wear resistance than conducting agents such as carbon black. Indium tin oxide may be produced by known methods (for example, see Japanese Patent No. 4686776), or general-purpose products available from Mitsubishi Materials Corporation, MITSUI MINING & SMELTING CO., LTD., and JGC Catalysts and Chemicals Ltd. may be used.

The resistance of the surface layer 14 can be controlled by controlling the ratio between a binder resin and antimony-doped tin oxide or indium tin oxide. The proportion of antimony-doped tin oxide or indium tin oxide in the surface layer 14 is typically from 1% to 30% by mass, and preferably from 5% to 10% by mass. Specific examples of the binder resin include insulating resins having a high resistivity of $1\times10^{11}$ Ω·cm or more, such as polyester, nylon, acrylic, and polyvinyl alcohol. For forming the surface layer, resins soluble in water or low-boiling-point solvents are particularly preferred. The surface resistivity of the surface layer is preferably from $1\times10^{4}$ to $1\times10^{11}$Ω/□, and particularly preferably from $1\times10^{6}$ to $1\times10^{9}$Ω/□. The surface resistivity of $1\times10^{4}$Ω/□ or more is appropriate to generate a sufficient transfer electric field and to improve the toner transfer performance. The surface resistivity of $1\times10^{11}$Ω/□ or less is appropriate to suitably adjust the conductivity and to improve the transfer performance by the surface layer. The surface resistivity can be measured by forming a 1 μm-thick surface layer on a polyethylene terephthalate (PET) film and applying a voltage of 10 V for 10 seconds using HIRESTA UP (or LORESTA GP), product of Mitsubishi Chemical Analytech Co., Ltd. It should be noted that the measurement of the surface layer which is laminated on the belt may be affected by the resistance of the underlying rubber and may not provide an accurate resistance. The thickness of the surface layer is preferably from 0.1 to 5 μm, particularly preferably from 0.5 to 2 μm. When the thickness is less than 0.1 μm, the effect of the surface layer is lowered. When the thickness is more than 5 μm, the surface layer is bent as a roller drives, and peeled off or broken, lowering durability. Preferably, the spherical particles 13 are exposed at the outermost surface of the surface layer 14 to form an uneven shape.

Preferably, the spherical particles are true spherical particles for enhancing toner transfer efficiency.

The true spherical particle is defined as follows.

Figure 3:
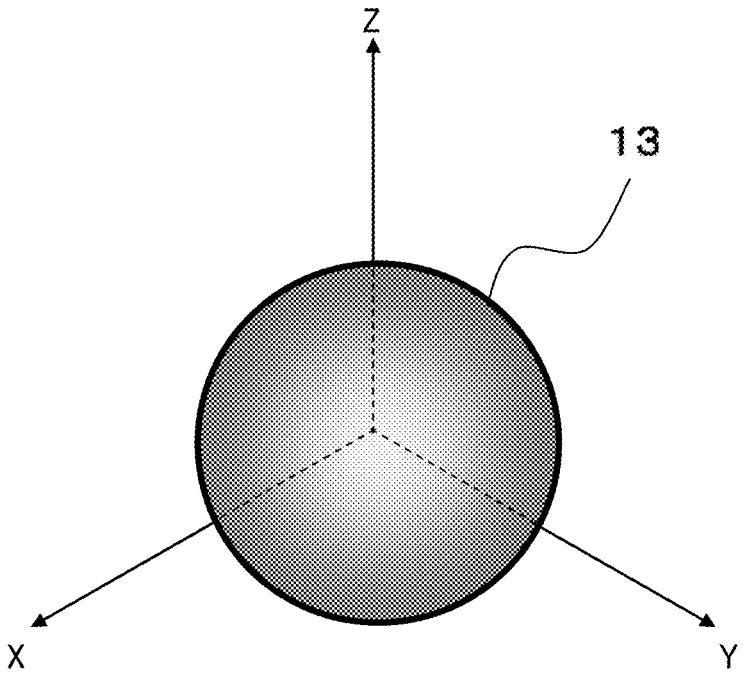
FIG. 3 is a schematic diagram illustrating the shape of a spherical particle.
Figure 4:
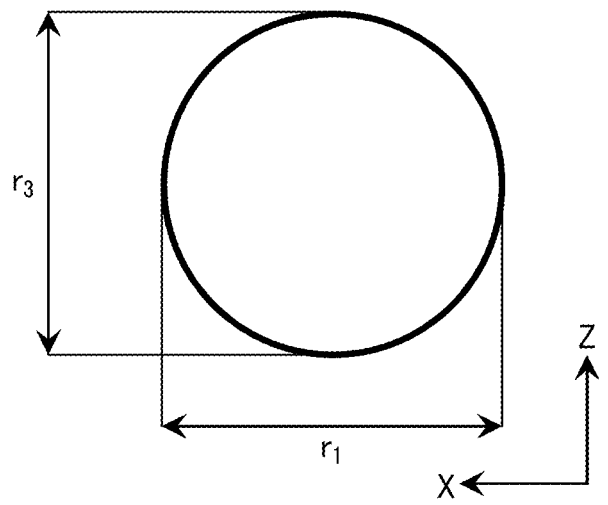
FIG. 4 is a schematic diagram illustrating the shape of a spherical particle.
Figure 5:
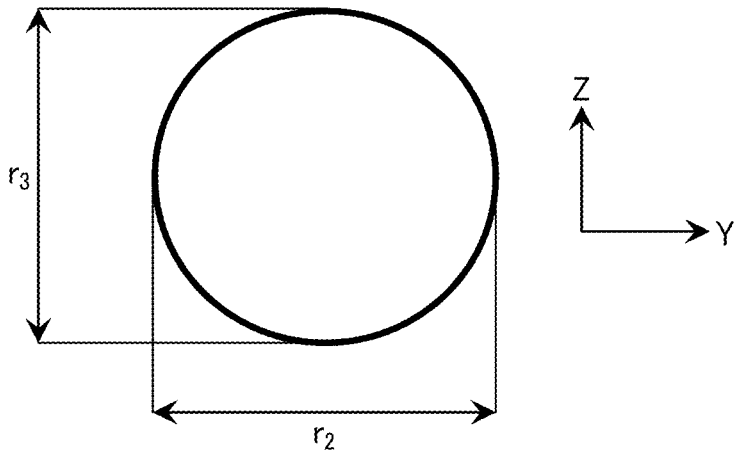
FIG. 5 is a schematic diagram illustrating the shape of a spherical particle.

FIGS. 3 to 5 are schematic diagrams illustrating the shapes of the spherical particle of the present disclosure.

In FIGS. 4 and 5, a particle is defined by a long axis r1, a short axis r2, and a thickness r3 (where r1≥r2≥r3). When the ratio (r2/r1) of the long axis r2 to the short axis r1 is from 0.9 to 1.0 and the ratio (r3/r2) of the thickness r3 to the short axis r2 is from 0.9 to 1.0, the particle is defined as a true spherical particle.

When the ratio (r2/r1) of the long axis r2 to the short axis r1 and the ratio (r3/r2) of the thickness r3 to the short axis r2 are both 0.9 or more, the spherical particles 13 can be aligned at the surface of the elastic layer 12, and the toner transfer efficiency is improved.

The long axis r1, short axis r2, and thickness r3 can be determined by, for example, uniformly dispersing and adhering particles onto a smooth measurement surface, observing 100 randomly-selected particles with a color laser microscope VK-8500 (product of Keyence Corporation) at an arbitrary magnification (for example, 1,000 times) to measure the long axis r1 (μm), short axis r2 (μm), and thickness r3 (μm) of each particle, and calculating an arithmetic mean value for each of r1, r2, and r3.

Surface Condition of Belt

Next, the surface condition of the intermediate transfer belt in the present embodiment is described in detail below.

Figure 6:
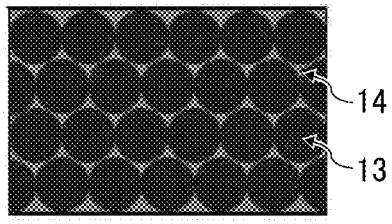
FIG. 6 is an enlarged schematic diagram illustrating the surface of an intermediate transfer belt observed from directly above.

FIG. 6 is an enlarged schematic diagram of the surface of the intermediate transfer belt observed from directly above. As illustrated, the spherical particles having a uniform particle diameter are arranged independently and orderly. Almost no overlap between the particles is observed. The cross-sectional diameters of the particles constituting the surface are also preferably uniform, and specifically, the distribution width thereof is preferably ±(average particle diameter×0.5) μm or less.

It is preferable to form the surface with such particles having a uniform particle diameter as much as possible. It is also possible to form the surface with particles having a certain particle diameter which are selected to have the above-described particle diameter distribution, without using the particles having a uniform particle diameter.

The ratio of the surface area occupied by the particles is preferably 60% or more. When the ratio is 60% or less, the exposed portion of the resin is too large, and the toner comes into contact with rubber, resulting in poor transfer performance.

In the present embodiment, the spherical particles are partially embedded in the elastic layer. The embedment rate is preferably more than 50% and less than 100%, more preferably from 51% to 90%. When the embedment rate is 50% or more, the particles are prevented from detaching even after used in an image forming apparatus for a long period, and durability is improved. When the average embedment rate is less than 100%, the effect of the spherical particles on transfer performance is improved.

The embedment rate is the rate of embedment of the diameter of the spherical particle in the elastic layer in the depth direction. Here, the embedment rate does not require that all the particles be embedded at an embedment rate of more than 50% and less than 100% and just requires that the average value of the embedment rates for the particles observed in a certain visual field be more than 50% and less than 100%. When the embedment rate is 50%, a particle which is almost completely embedded in the elastic layer is hardly observed in a cross-section observed by an electron microscope. (Such particles which are almost completely embedded in the elastic layer account for 5% by number or less of all the particles.)

Next, a method for manufacturing the intermediate transfer belt according to an embodiment of the present invention is described in detail below. First, a method for preparing the base layer 11 is described.

A method for preparing the base layer 11 using a coating liquid containing the polyimide resin precursor or polyamideimide resin precursor is described below.

The coating liquid containing at least a resin component (e.g., the polyimide resin precursor, the polyamideimide resin precursor) is uniformly applied to and casted on the outer surface of a cylinder (e.g., cylindrical metallic mold) by a liquid supplying device (e.g., nozzle, dispenser) while the cylinder is rotated slowly, thus forming a coating film. The rotation speed is thereafter increased to a predetermined speed and maintained at the predetermined speed for a desired time. The temperature is gradually increased while rotating the cylinder so that the solvent in the coating film is volatilized at a temperature of about 80° C. to 150° C. In this process, it is preferable to efficiently circulate and remove the vapor of the atmosphere (e.g., volatilized solvent). At the time when a self-supportive film is formed, the film together with the mold is put in a heating furnace (firing furnace) capable of high-temperature treatment. The temperature is raised stepwise, and a high-temperature heat treatment (firing) is finally performed at about 250° C. to 450° C. to convert the polyimide resin precursor or polyamideimide resin precursor into the polyimide resin or polyamideimide resin. After the resulting base layer is sufficiently cooled, the elastic layer 12 is subsequently laminated thereon.

The elastic layer 12 can be prepared by coating the base layer 11 with a rubber coating material in which a rubber is dissolved in an organic solvent, then drying the solvent, and vulcanizing the rubber. The coating method may be selected from known coating methods such as spiral coating, die coating, and roll coating. To improve transfer performance onto uneven surfaces, it is preferable that the elastic layer 12 is thick. To form a thick film, die coating and spiral coating are preferred. To easily vary the thickness of the elastic layer in the width direction, spiral coating is preferred. Details of the spiral coating are described below. First, a rubber coating material is continuously supplied from a round-shape or wide-width nozzle being moved in the axial direction of the base layer, while the base layer is rotated in the circumferential direction, so that the base layer is coated with the coating material in a spiral manner. The coating material spirally applied to the base layer is leveled and dried as the rotation speed and drying temperature are maintained. The rubber is further vulcanized (cross-linked) at a certain vulcanization temperature. The film thickness can be varied in the width direction by changing the discharge amount from the nozzle, the distance between the nozzle and the die, or the rotation speed of the die.

Method for Adjusting Surface Condition of Belt

Figure 7:
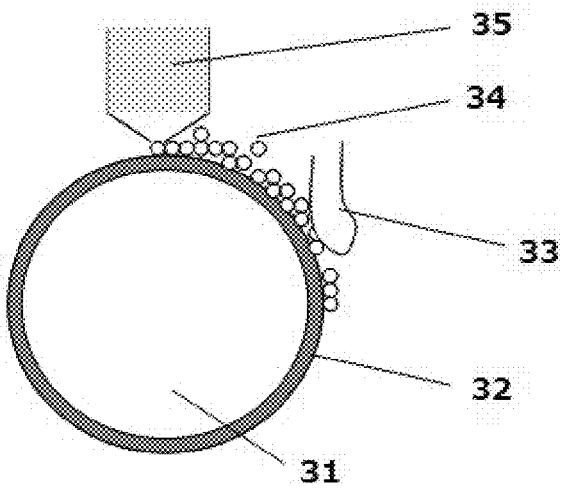
FIG. 7 is a schematic diagram illustrating a method of applying spherical particles to an elastic layer.

The vulcanized elastic layer 12 is sufficiently cooled, and subsequently the spherical particles 13 are applied onto the elastic layer 12 to obtain a desired seamless belt (i.e., intermediate transfer belt). A spherical particle layer consisting of the spherical particles may be formed using a powder supply device 35 and a pressing member 33 illustrated in FIG. 7. The powder supply device 35 uniformly dusts a surface of a belt 32 with spherical particles 34 while a metal mold drum 31 around which the belt 32 is wound is rotated. The spherical particles 34 on the surface of the belt 32 are pressed by the pressing member 33 at a constant pressure. The pressing member 33 embeds the spherical particles 34 in the elastic layer 12 while removing surplus particles. Since monodisperse spherical particles are used in the present embodiment, it is possible to form a homogeneous single particle layer by a simple process of leveling with the pressing member 33. The embedment rate is adjusted by adjusting the length of the pressing time of the pressing member 33.

The embedment rate of the particles may also be adjusted by another method. For example, the adjustment is easily conducted by adjusting the pressing force of the pressing member 33. For example, it is relatively easy to achieve the embedment rate of more than 50% and less than 100% by adjusting the pressing force to 1 to 1,000 mN/cm when the viscosity of the coating liquid is from 100 to 100,000 mPa·s, although it depends on the viscosity, solid content, solvent content, particle material, etc., of the coating liquid.

After the spherical particles are uniformly arranged on the surface of the elastic layer 12, the belt is heated at a predetermined temperature for a predetermined time to be hardened, while being rotated, thereby forming the elastic layer 12 in which the particles are embedded. After being sufficiently cooled, the elastic layer along with the base layer is detached from the mold to obtain a desired seamless belt (i.e., intermediate transfer belt).

Method for Measuring Embedment Rate of Spherical Particles in Intermediate Transfer Belt A method for measuring the embedment rate of the spherical particles in the intermediate transfer belt is not particularly limited and can be suitably selected to suit to a particular application, and can be measured by observing a cross-section of the intermediate transfer belt with a scanning electron microscope (SEM).

Method for Preparing Surface Layer

Next, a method for forming the surface layer 14 over the spherical particles 13 on the elastic layer 12 is described. A coating material in which a resin is dissolved in a solvent and antimony-doped tin oxide or indium tin oxide is dispersed therein is applied onto the spherical particles 13 to form a thin film thereof. The coating method is not particularly limited, and examples thereof include spray coating, roll coating, gravure coating, and slit coating. The belt is thereafter heated to volatilize the solvent to obtain a coating film. In order not to degrade the rubber by heat, water or a solvent that volatilizes at about 100° C. should be used. The heating time is usually from 1 minute to 1 hour.

Image Forming Apparatus

An image forming apparatus according to an embodiment of the present invention includes: an image bearer to bear a latent image; a developing device to develop the latent image on the image bearer with toner to form a toner image; an intermediate transfer belt onto which the toner image is to be primarily transferred; and a transfer device to secondarily transfer the toner image from the intermediate transfer belt onto a recording medium. Here, the intermediate transfer belt is in accordance with an embodiment of the present invention. The image forming apparatus may further include other devices such as a neutralizer, a cleaner, a recycler, and a controller, as necessary.

It is preferable that the image forming apparatus is a full-color image forming apparatus in which multiple pairs of a latent image bearer and a developing device containing a different color toner are arranged in series.

An image forming apparatus according to an embodiment of the present invention equipped with a seamless belt is described in detail below with reference to the drawings. The drawings are for the purpose of illustration only and are not intended to be limiting.

Figure 8:
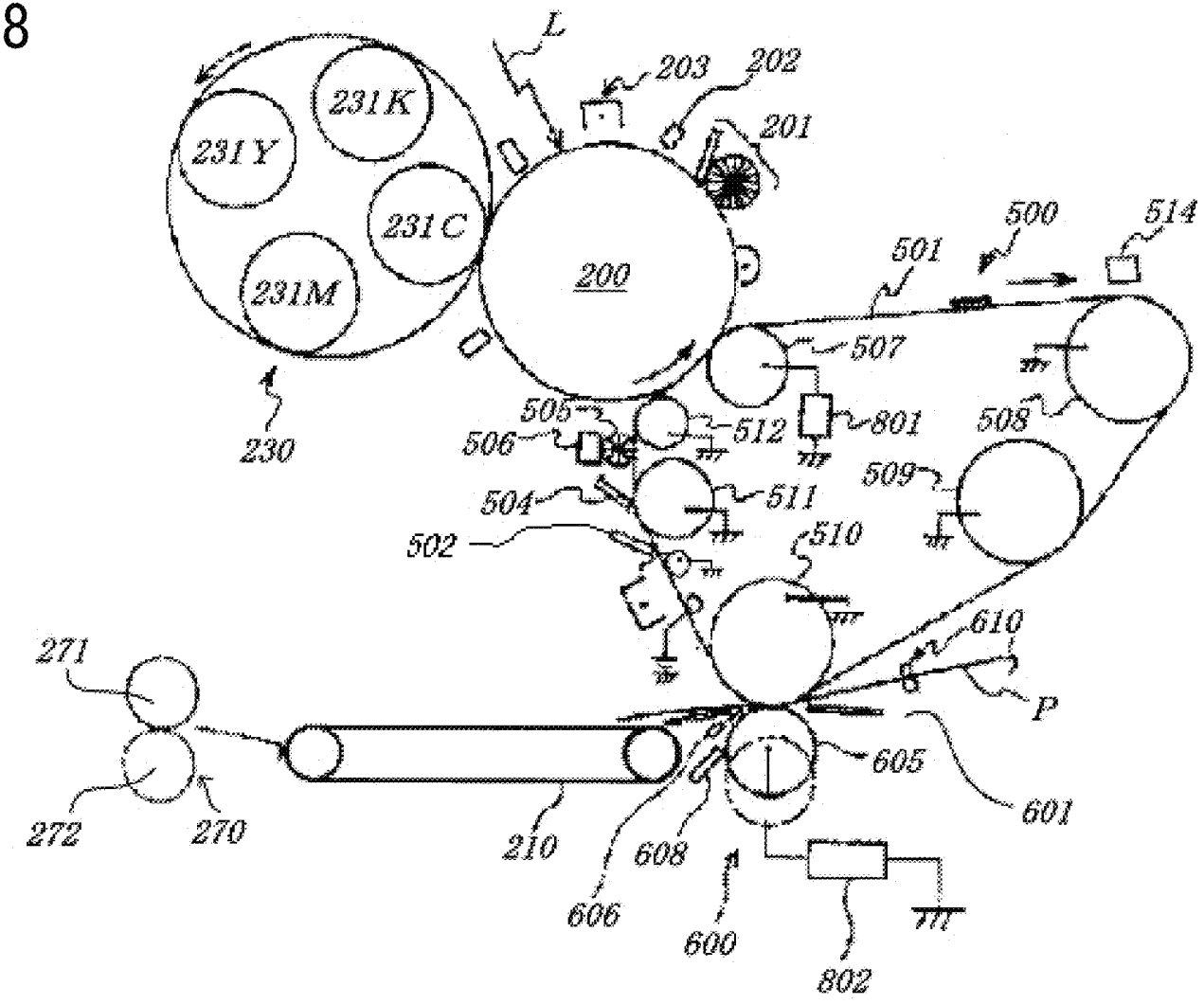
FIG. 8 is a schematic diagram illustrating an image forming apparatus according to an embodiment of the present invention.

FIG. 8 is a schematic diagram illustrating a main part of an image forming apparatus equipped with a seamless belt according to an embodiment of the present invention.

An intermediate transfer unit 500 illustrated in FIG. 8 includes an intermediate transfer belt 501, serving as an intermediate transferor, stretched around multiple rollers. Around the intermediate transfer belt 501, a secondary transfer bias roller 605 serving as a secondary transfer charger of a secondary transfer unit 600, a belt cleaning blade 504 serving as an intermediate transferor cleaner, and a lubricant application brush 505 serving as a lubricant applicator are disposed facing the intermediate transfer belt 501.

A position detection mark is provided on the outer circumferential surface or inner circumferential surface of the intermediate transfer belt 501. On the outer circumferential surface of the intermediate transfer belt 501, the position detection mark should be provided avoiding the area where the belt cleaning blade 504 passes, which may make an arrangement more difficult. In such a case, the position detection mark may be provided on the inner circumferential surface of the intermediate transfer belt 501. An optical sensor 514 serving as a mark detection sensor is disposed facing the intermediate transfer belt 501 at a position between a primary transfer bias roller 507 and a belt driving roller 508 between which the intermediate transfer belt 501 is stretched.

The intermediate transfer belt 501 is stretched around the primary transfer bias roller 507 serving as a primary transfer charger, the belt driving roller 508, a belt tension roller 509, a secondary transfer opposing roller 510, a cleaning opposing roller 511, and a feedback current detecting roller 512. Each of the rollers is made of a conductive material, and each of the rollers other than the primary transfer bias roller 507 is grounded. The primary transfer bias roller 507 is applied with a transfer bias controlled to a current or voltage of a predetermined magnitude according to the number of overlapping toner images by a primary transfer power source 801 controlled at a constant current or a constant voltage.

The intermediate transfer belt 501 is driven to move in the direction indicated by arrow by the belt driving roller 508 driven to rotate in the direction indicated by arrow by a driving motor.

The intermediate transfer belt 501 may be made of a semiconductor or an insulator and may have a monolayer or multilayer structure. In the present disclosure, a seamless belt is preferably used therefor, which provides excellent durability and image quality. The intermediate transfer belt 501 is made larger than the maximum size of sheet to make it possible to superimpose toner images formed on a photoconductor drum 200 thereon.

The secondary transfer bias roller 605 serving as a secondary transfer device is brought into contact with and separated from, by a contact-separation mechanism, a portion of the outer circumferential surface of the intermediate transfer belt 501 which is stretched around the secondary transfer opposing roller 510. The secondary transfer bias roller 605 is disposed such that a transfer sheet P serving as a recording medium can be sandwiched between the secondary transfer bias roller 605 and a portion of the intermediate transfer belt 501 which is stretched around the secondary transfer opposing roller 510. The secondary transfer bias roller 605 is applied with a transfer bias of a predetermined current by a secondary transfer power source 802 controlled at a constant current.

A registration roller 610 feeds the transfer sheet P to between the secondary transfer bias roller 605 and the intermediate transfer belt 501 that is stretched around the secondary transfer opposing roller 510 at a predetermined timing. A cleaning blade 608 serving as a cleaner is in contact with the secondary transfer bias roller 605. The cleaning blade 608 removes deposits adhering to the surface of the secondary transfer bias roller 605 to clean the secondary transfer bias roller 605.

As an image forming cycle is started in this image forming apparatus, the photoconductor drum 200 is rotated counterclockwise as indicated by arrow by a driving motor, and a black (Bk) toner image, a cyan (C) toner image, a magenta (M) toner image, and a yellow (Y) toner image are formed on the photoconductor drum 200. The intermediate transfer belt 501 is rotated clockwise as indicated by arrow by the belt driving roller 508. As the intermediate transfer belt 501 rotates, the Bk toner image, the C toner image, the M toner image, and the Y toner image are primarily transferred by a transfer bias that is a voltage applied to the primary transfer bias roller 507. The toner images are then superimposed on the intermediate transfer belt 501 in the order of Bk, C, M and Y.

As an example, the Bk toner image can be formed by the following process.

Referring to FIG. 8, a charger 203 uniformly charges the surface of the photoconductor drum 200 to a predetermined negative potential by a corona discharge. The photoconductor drum 200 is then exposed to laser light L emitted from an optical writing unit based on a Bk color image signal (i.e., raster exposure) at a timing determined based on a belt mark detection signal. At the time of the raster exposure, in the exposed portion of the uniformly-charged surface of the photoconductor drum 200, an amount of charge proportional to the amount of exposure light disappears and a Bk electrostatic latent image is formed. As a negatively-charged Bk toner on a developing roller of a Bk developing device 231K is brought into contact with the Bk electrostatic latent image, the toner does not adhere to a portion of the photoconductor drum 200 where the electric charge remains but adsorbs to the exposed portion thereof where the electric charge is absent. Thus, a Bk toner image having a similar shape to the Bk electrostatic latent image is formed.

The Bk toner image thus formed on the photoconductor drum 200 is primarily transferred onto the outer circumferential surface of the intermediate transfer belt 501 that is driven to rotate at a constant speed in contact with the photoconductor drum 200. A small amount of untransferred residual toner remaining on the surface of the photoconductor drum 200 after the primary transfer is removed by a photoconductor cleaner 201 in preparation for reuse of the photoconductor drum 200. On the other hand, the photoconductor drum 200 proceeds to a C image forming process that follows the Bk image forming process. In the C image forming process, a color scanner starts reading of C image data at a predetermined timing and the C image data is written on the surface of the photoconductor drum 200 with laser light to form a C electrostatic latent image.

After the trailing end portion of the Bk electrostatic latent image passes a developing position and before the leading end portion of the C electrostatic latent image reaches the developing position, a revolver developing unit 230 rotates to allocate a C developing device 231C to the developing position. Thus, the C electrostatic latent image is developed with a C toner. The development is continued at the C electrostatic latent image area. At the time when the trailing end portion of the C electrostatic latent image passes the developing position, the revolver developing unit 230 rotates again to allocate an M developing device 231M to the developing position. The rotation is completed before the leading end portion of the next Y electrostatic latent image reaches the developing position. Detailed descriptions for M and Y image forming processes are omitted since the operations in color image data reading, electrostatic latent image formation, and developing in the M and Y image forming processes are the same as those in the Bk and C image forming processes described above.

The toner images of Bk, C, M, and Y sequentially formed on the photoconductor drum 200 are primarily transferred onto the same surface of the intermediate transfer belt 501 in a sequential manner with position alignment. As a result, a composite toner image is formed on the intermediate transfer belt 501, in which at most four color toners are superimposed. On the other hand, at the time when the image forming operation is started, the transfer sheet P is fed from a sheet feeder, such as a transfer sheet cassette or a manual sheet feeding tray, and stands by at the nip of the registration roller 610.

The registration roller 610 is driven to convey the transfer sheet P along a transfer sheet guide plate 601 in synchronization with an entry of the leading end of the composite toner image on the intermediate transfer belt 501 into a secondary transfer portion where a nip is formed between the intermediate transfer belt 501 stretched around the secondary transfer opposing roller 510 and the secondary transfer bias roller 605, so that the leading end of the transfer sheet P coincides with the leading end of the toner image, thus achieving a registration of the transfer sheet P and the toner image.

As the transfer sheet P passes through the secondary transfer portion, the composite toner image in which four color toners are superimposed on the intermediate transfer belt 501 are collectively transferred onto the transfer sheet P (i.e., secondary transfer) by a transfer bias that is a voltage applied to the secondary transfer bias roller 605 by the secondary transfer power source 802. The transfer sheet P is conveyed along the transfer sheet guide plate 601 and subjected to charge removal by passing through a portion facing a transfer sheet charge removing device 606 having a charge removing needle, disposed downstream from the secondary transfer portion. The transfer sheet P is further conveyed to a fixing device 270 by a belt conveying device 210. The composite toner image is fused and fixed on the transfer sheet P at a nip portion formed between fixing rollers 271 and 272 in the fixing device 270. The transfer sheet P is ejected to the outside of the main body of the apparatus by an ejection roller and stacked face-up on a copy tray. The fixing device 270 may be equipped with a belt component as necessary.

On the other hand, after the transfer of the composite toner image, the surface of the photoconductor drum 200 is cleaned by the photoconductor cleaner 201 and uniformly electrically neutralized by a charge removing lamp 202. Residual toner remaining on the outer circumferential surface of the intermediate transfer belt 501 after the composite toner image is secondarily transferred therefrom onto the transfer sheet P is cleaned by the belt cleaning blade 504. The belt cleaning blade 504 is configured to contact and separate from the outer circumferential surface of the intermediate transfer belt 501 at a predetermined timing by a cleaning member contact-separation mechanism.

On the upstream side of the belt cleaning blade 504 in the direction of movement of the intermediate transfer belt 501, a toner sealing member 502 that contacts and separates from the outer circumferential surface of the intermediate transfer belt 501 is disposed. The toner sealing member 502 receives toner falling from the belt cleaning blade 504 during removal of residual toner and prevents the falling toner from scattering onto the conveyance path of the transfer sheet P. The toner sealing member 502 is brought into contact with and separated from the outer circumferential surface of the intermediate transfer belt 501 together with the belt cleaning blade 504 by the cleaning member contact-separation mechanism.

A lubricant 506 scraped off by the lubricant application brush 505 is applied to the outer circumferential surface of the intermediate transfer belt 501 from which the residual toner has been removed. The lubricant 506 is made of a solid material such as zinc stearate and is disposed in contact with the lubricant application brush 505. Residual charge remaining on the outer circumferential surface of the intermediate transfer belt 501 is removed by a charge removing bias applied by a belt charge removing brush in contact with the outer circumferential surface of the intermediate transfer belt 501. The lubricant application brush 505 and the belt charge removing brush are brought into contact with and separated from the outer circumferential surface of the intermediate transfer belt 501 at a predetermined timing by respective contact-separation mechanisms.

At the time of repeat copying, the color scanner and the photoconductor drum 200 operate at a predetermined timing to proceed to image formation of the first color (BK) in the second copy, following image formation of the fourth color (Y) in the first copy. The Bk toner image in the second copy is then primarily transferred onto the outer circumferential surface of the intermediate transfer belt 501 at an area which is cleaned by the belt cleaning blade 504, after the composite toner image in the first copy, in which four color toners are superimposed, is collectively transferred onto the transfer sheet. The image forming operation then proceeds in the same manner as in the first copy. The above description relates to a four-color (full-color) copy mode. In the case of a three-color copy mode or a two-color copy mode, the same operation as described above is performed for the designated color and number of times. In the case of a single color copy mode, one of the developing devices in the revolver developing unit 230 which corresponds to the predetermined color is put into developing operation while the belt cleaning blade 504 is kept in contact with the intermediate transfer belt 501, until copying on the predetermined number of sheets is completed.

The above-described embodiment provides an image forming apparatus (copier) including only one photoconductor drum. Another embodiment of the present invention provides an image forming apparatus including a plurality of photoconductor drums arranged side by side along one intermediate transfer belt composed of a seamless belt, as illustrated in FIG. 9.

Figure 9:
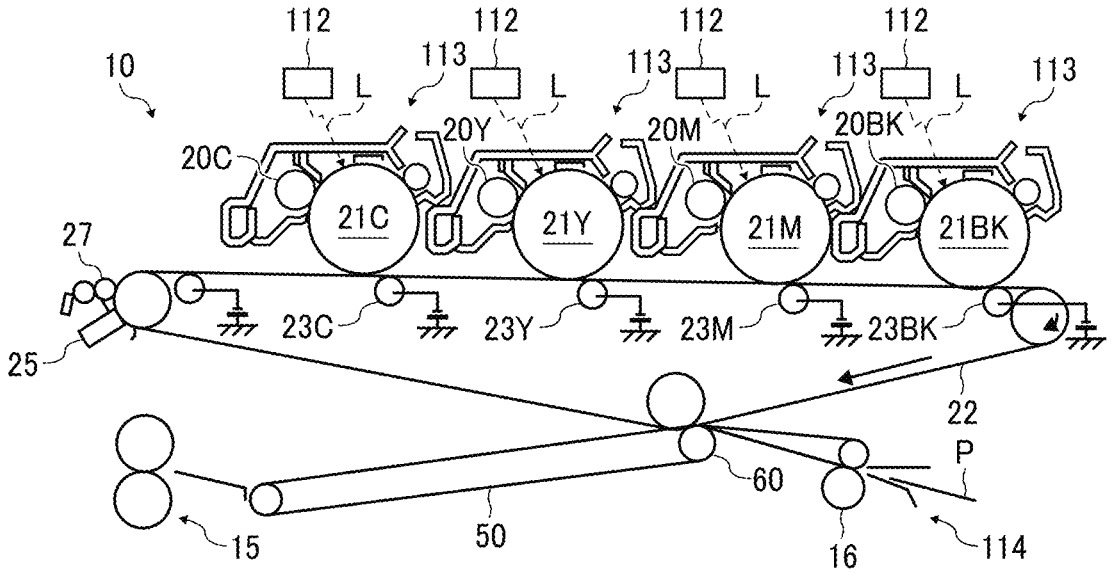
FIG. 9 is a schematic diagram illustrating an image forming apparatus according to an embodiment of the present invention.

FIG. 9 is a schematic diagram illustrating a four-drum-type digital color printer including four photoconductor drums ("photoconductors") 21BK, 21M, 21Y, and 21C for forming toner images of four different colors of black, magenta, yellow, and cyan, respectively.

Referring to FIG. 9, a printer main body 10 includes image writing units 112, image forming units 113, and a sheet feeder 114, for forming a color image by electrophotography. An image processor performs an image processing to convert an image signal into color signals of black (BK), magenta (M), yellow (Y), and cyan (C) used for image formation and transmits the color signals to the image writing units 112. Each image writing unit 112 may be a laser scanning optical system composed of a laser light source, a deflector such as a rotating polygon mirror, a scanning image forming optical system, and a mirror group. The image writing units 112 have four optical paths for writing images on the respective photoconductors (image bearers) 21BK, 21M, 21Y, and 21C provided in the image forming units 113, based on the respective color signals.

The image forming units 113 include the photoconductors 21BK, 21M, 21Y, and 21C serving as image bearers for black (BK), magenta (M), yellow (Y), and cyan (C), respectively. Each of the photoconductors may be an organic photoconductor (OPC). Around each of the photoconductors 21BK, 21M, 21Y, and 21C, a charger, an exposure portion to expose the photoconductor to laser light L emitted from the image writing unit 112, a developing device 20BK, 20M, 20Y, or 20C (corresponding to black, magenta, yellow, and cyan, respectively), a primary transfer bias roller 23BK, 23M, 23Y, or 23C serving as a primary transferrer, a cleaner, and a photoconductor charge removing device are disposed. The developing devices 20BK, 20M, 20Y, and 20C each employ a two-component magnetic brush developing method. An intermediate transfer belt 22 is interposed between the group of photoconductors 21BK, 21M, 21Y, and 21C and the group of primary transfer bias rollers 23BK, 23M, 23Y, and 23C. Toner images formed on the photoconductors 21BK, 21M, 21Y, and 21C are sequentially superimposed and transferred onto the intermediate transfer belt 22.

On the other hand, a transfer sheet P is fed from the sheet feeder 114 and carried on a transfer conveyance belt 50 via a registration roller 16. At a position where the intermediate transfer belt 22 and the transfer conveyance belt 50 are in contact with each other, the toner images transferred onto the intermediate transfer belt 22 are secondarily and collectively transferred by a secondary transfer bias roller 60 serving as a secondary transferrer. Thus, a full-color image is formed on the transfer sheet P. The transfer sheet P on which the full-color image is formed is conveyed to a fixing device 15 by the transfer conveyance belt 50. The fixing device 15 fixes the full-color image on the transfer sheet P, and the transfer sheet P is ejected to the outside of the printer body.

Residual toner remaining on the intermediate transfer belt 22 without being transferred in the secondary transfer is removed from the intermediate transfer belt 22 by a belt cleaner 25. On the downstream side of the belt cleaner 25, a lubricant applicator 27 is disposed. The lubricant applicator 27 includes a solid lubricant and a conductive brush that rubs against the intermediate transfer belt 22 to apply the solid lubricant thereto. The conductive brush is in constant contact with the intermediate transfer belt 22 to apply the solid lubricant to the intermediate transfer belt 22. The solid lubricant enhances cleanability of the intermediate transfer belt 22, prevents the occurrence of filming, and improves durability.

EXAMPLES

Further understanding can be obtained by reference to certain specific examples which are provided herein for the purpose of illustration only and are not intended to be limiting. Volume resistivity of the spherical particles was measured using instruments MCP-PD51, LORESTA GP, and HIRESTA UP, products of Mitsubishi Chemical Analytech Co., Ltd. Specifically, in an environment of 23° C., 50% RH, 1 g of the particles was placed in a pressurized container having a diameter of 15 mm and applied with a load of 4 KN, then a value at 20 KV was read to calculate the resistivity. Surface resistivity of the surface layer was determined by measuring a 1 μm-thick coating on a polyethylene terephthalate (PET) film using HIRESTA UP (or LORESTA GP) in an environment of 23° C., 50% RH, and reading a value after applying a bias of 10 V for 10 seconds as the surface resistivity.

Example 1

A base layer coating liquid was prepared as follows. A seamless belt base layer was prepared using this coating liquid.

Preparation of Base Layer Coating Liquid

First, a carbon black (SPECIAL BLACK 4, product of Evonik Degussa) was dispersed in N-methyl-2-pyrrolidone using a bead mill, and the resultant liquid dispersion was blended in a polyimide varnish (U-VARNISH A, product of Ube Industries, Ltd.) containing a polyimide resin precursor as a main component, such that the carbon black content became 17% by mass of the polyamic acid solid content. The mixture was thoroughly stirred and mixed to prepare a base layer coating liquid.

Preparation of Polyimide Base Layer Belt

Next, a metallic cylindrical support, serving as a mold, having an outer diameter of 360 mm, a length of 400 mm, and an outer surface roughened by blasting was attached to a roll coater.

Subsequently, the base layer coating liquid was poured into a pan and drawn up by a coating roller rotating at a rotation speed of 40 mm/sec. The thickness of the coating liquid drawn up on the coating roller was controlled by adjusting the gap between a regulating roller and the coating roller to 0.6 mm.

The cylindrical support was then brought close to the coating roller while being controlled to rotate at a rotation speed of 35 mm/sec to make the gap between the cylindrical support and the coating roller be 0.4 mm, so that the coating liquid carried on the coating roller was uniformly transferred onto the cylindrical support. The cylindrical support was then put in a hot air circulating dryer while keeping rotating, gradually heated to 110° C. and kept for 30 minutes, further heated to 200° C. and kept for 30 minutes, and stopped rotating. The cylindrical support was then introduced into a heating furnace (firing furnace) capable of high temperature treatment and heated to 320° C. stepwise to be fired for 60 minutes. After sufficient cooling, a polyimide base layer belt having a film thickness of 60 μm was prepared.

Preparation of Elastic Layer on Polyimide Base Layer Belt

The following components were blended and kneaded to prepare a rubber composition.

- Acrylic rubber (NIPOL AR12, product of Zeon Corporation): 100 parts by mass
- Stearic acid (STEARIC ACID CAMELLIA, product of NOF CORPORATION): 1 part by mass
- Aluminum phosphinate (EXOLIT OP935, product of Clariant Chemicals K.K.): 30 parts by mass
- Cross-linking agent (DIAK. No. 1, hexamethylenediamine carbamate, product of Du Pont Dow Elastomer Japan): 0.6 parts by mass
- Cross-linking accelerator (VULCOFAC ACT 55, 70% of a salt of 1,8-diazabicyclo(5,4,0)undecene-7 and diprotic acid and 30% of amorphous silica, product of Safic-Alcan): 0.6 parts by mass The rubber composition was dissolved in an organic solvent (MIBK: methyl isobutyl ketone) to prepare a rubber solution having a solid content of 35% by weight. The cylindrical support on which the polyimide base layer was formed was rotated to be spirally coated with the above-prepared rubber solution that was continuously discharged from a nozzle moving in the direction of axis of the cylindrical support. The amount of coating was determined such that the film thickness became 400 μm. The cylindrical support coated with the rubber solution was put in a hot air circulating dryer while kept rotating and heated to 90° C. at a heating rate of 4° C./min and maintained for 30 minutes.

Next, acrylic spherical particles having an average particle diameter of 2.0 μm (TECHPOLYMER SSX-102, product of Sekisui Kasei Co., Ltd.) were made coated with nickel by electroless plating to prepare nickel-plated particles having a resistivity of $1\times10^{7}$ Ω·cm. Next, the surface of the heated rubber composition was evenly dusted with the acrylic spherical fine particle using the device illustrated in FIG. 7, and the pressing member 33 that is a polyurethane rubber blade was pressed against the elastic layer (rubber layer) at a pressing force of 100 mN/cm. Subsequently, the cylindrical support was put in the hot air circulating dryer again and heated to 170° C. at a heating rate of 4° C./min and maintained for 60 minutes. The embedment rate of the acrylic spherical particles was 60%.

Preparation of Surface Layer 1

Next, antimony-doped tin oxide (trade name 4700, product of MITSUI MINING & SMELTING CO., LTD.) and methanol were ultrasonically dispersed, and then an alcohol-soluble nylon (trade name CM8000, product of Toray Industries, Inc.) was added and sufficiently stirred to prepare a conductive polymer coating material. After that, the coating material was applied onto the elastic layer by spray coating and heated at 100° C. for 5 minutes, thus obtaining an intermediate transfer belt A. The surface resistivity of the surface layer was $1\times10^{7}$Ω/□. The thickness of the surface layer was 1.0 μm.

Example 2

An intermediate transfer belt B was obtained in the same manner as in Example 1 except that the surface resistivity of the surface layer was adjusted to $5\times10^{11}$Ω/□.

Example 3

An intermediate transfer belt C was obtained in the same manner as in Example 1 except that the surface resistivity of the surface layer was adjusted to $2\times10^{3}$Ω/□.

Example 4

An intermediate transfer belt D was obtained in the same manner as in Example 1 except that the thickness of nickel on the spherical particles was changed to adjust the volume resistivity of the particles to $4\times10^{11}$ Ω·cm.

Example 5

An intermediate transfer belt E was obtained in the same manner as in Example 1 except that the thickness of nickel on the spherical particles was changed to adjust the volume resistivity of the particles to $6\times10^{3}$ Ω·cm.

Example 6

The procedure in Example 1 was repeated except that the nickel-plated particles were replaced with conductive spherical particles. Here, the conductive spherical particles were polythiophene-coated particles obtained by spray-coating the acrylic spherical particles of Example 1 with a polythiophene-based conductive polymer DENATRON PT-434 (product of Nagase ChemteX Corporation), followed by drying at 120° C. for 1 hour. Thus, an intermediate transfer belt F was obtained. The volume resistivity of the particles was $2\times10^{7}$ Ω·cm.

Comparative Example 1

An intermediate transfer belt G was obtained in the same manner as in Example 1 except that the antimony-doped tin oxide was not added to the surface layer. At this time, the surface resistivity of the surface layer was overrange (i.e., $1\times10^{12}$Ω/□ or more).

Comparative Example 2

An intermediate transfer belt H was obtained in the same manner as in Example 1 except that the surface layer was not laminated.

Comparative Example 3

An intermediate transfer belt I was obtained in the same manner as in Example 1 except that the spherical particles were not used.

Example 7

An intermediate transfer belt J was obtained in the same manner as in Example 1 except that the procedure in "Preparation of Surface Layer 1" was changed to "Preparation of Surface Layer 2" described below. Preparation of Surface Layer 2 Indium tin oxide (trade name P-130, product of JGC Catalysts and Chemicals Ltd.) and methanol were ultrasonically dispersed, and then an alcohol-soluble nylon (trade name CM8000, product of Toray Industries, Inc.) was added and sufficiently stirred to prepare a conductive polymer coating material. After that, the coating material was applied onto the elastic layer by spray coating and heated at 100° C. for 5 minutes, thus obtaining an intermediate transfer belt J. The surface resistivity of the surface layer was $1\times10^{7}$Ω/□. The thickness of the surface layer was 1.0 μm.

Example 8

An intermediate transfer belt K was obtained in the same manner as in Example 7 except that the surface resistivity of the surface layer was adjusted to $5\times10^{11}$Ω/□.

Example 9

An intermediate transfer belt L was obtained in the same manner as in Example 7 except that the surface resistivity of the surface layer was adjusted to $2\times10^{3}$Ω/□.

Example 10

An intermediate transfer belt M was obtained in the same manner as in Example 7 except that the thickness of nickel on the spherical particles was changed to adjust the volume resistivity of the particles to $4\times10^{11}$ Ω·cm.

Example 11

An intermediate transfer belt N was obtained in the same manner as in Example 7 except that the thickness of nickel on the spherical particles was changed to adjust the volume resistivity of the particles to $6\times10^{3}$ Ω·cm.

Example 12

The procedure in Example 7 was repeated except that the nickel-plated particles were replaced with conductive spherical particles. Here, the conductive spherical particles were polythiophene-coated particles obtained by spray-coating the acrylic spherical particles of Example 7 with a polythiophene-based conductive polymer DENATRON PT-434 (product of Nagase ChemteX Corporation), followed by drying at 120° C. for 1 hour. Thus, an intermediate transfer belt O was obtained. The volume resistivity of the particles was $2\times10^{7}$ Ω·cm.

Comparative Example 4

An intermediate transfer belt P was obtained in the same manner as in Example 7 except that the spherical particles were not used.

The intermediate transfer belts A to P prepared in the above Examples and Comparative Examples were each mounted on RICOH MP C6003, which is the image forming apparatus illustrated in FIG. 9, and 20,000 sheets of A4-size thick coated paper NEW DV450 (product of Hokuetsu Corporation) were output. It was considered that the particles were likely to detach from the belt upon contact with the edges of the thick coated paper sheets. After that, A3-size sheets of the same paper were output. The resulting image was found to have longitudinally streaky white voids having the width of A4 size, and detachment of the particles was observed with a laser microscope. In the evaluation results, A rank indicates that no white void is observed, B rank indicates that white voids are slightly observed but the belt is practically usable, and C rank indicates that white voids are observed and the belt is practically unusable. The toner transfer rate after the output of the paper sheets was also measured. In the evaluation results for the transfer rate, A+ rank indicates 95% or more, A rank indicates 90% or more and less than 95%, B rank indicates from 80% to 90%, and C rank indicates less than 80%. (A+, A, and B ranks are acceptable.) Further, the surface condition of the intermediate transfer belt was observed with a microscope to examine detachment of the spherical particles.

The results are presented in Tables 1 and 2.

TABLE 1

| | | Surface Layer | | Spherical Particles | | After output of sheets | | Surface Observation (Detachment of Particles) |
|---|---|---|---|---|---|---|---|---|
| | Belt | Material | Surface Resistivity (Ω/□) | Material | Volume Resistivity (Ω · cm) | White Void Image | Transfer Rate | |
| Ex. 1 | A | Nylon + Antimony-doped Tin Oxide | $1\times10^{7}$ | Acrylic + Nickel plating | $1\times10^{7}$ | A | A+ | Not observed |
| Ex. 2 | B | Nylon + Antimony-doped Tin Oxide | $5\times10^{11}$ | Acrylic + Nickel plating | $1\times10^{7}$ | B | B | Partially observed |
| Ex. 3 | C | Nylon + Antimony-doped Tin Oxide | $2\times10^{3}$ | Acrylic + Nickel plating | $1\times10^{7}$ | B | B | Partially observed |
| Ex. 4 | D | Nylon + Antimony-doped Tin Oxide | $1\times10^{7}$ | Acrylic + Nickel plating | $4\times10^{11}$ | B | B | Partially observed |
| Ex. 5 | E | Nylon + Antimony-doped Tin Oxide | $1\times10^{7}$ | Acrylic + Nickel plating | $6\times10^{3}$ | B | B | Partially observed |
| Ex. 6 | F | Nylon + Antimony-doped Tin Oxide | $1\times10^{7}$ | Acrylic + Polythiophene coating | $2\times10^{7}$ | A | A | Not observed |
| Comp. Ex. 1 | G | Nylon | $1\times10^{12}$ | Acrylic + Nickel plating | $2\times10^{7}$ | C | C | Observed |
| Comp. Ex. 2 | H | — | — | Acrylic + Nickel plating | $2\times10^{7}$ | C | C | Observed |
| Comp. Ex. 3 | I | Nylon + Antimony-doped Tin Oxide | $1\times10^{7}$ | — | — | C | C | — |

TABLE 2

| | | Surface Layer | | Spherical Particles | | After output of sheets | | Surface Observation |
|---|---|---|---|---|---|---|---|---|
| | Belt | Material | Surface Resistivity (Ω/□) | Material | Volume Resistivity (Ω · cm) | White Void Image | Transfer Rate | (Detachment of Particles) |
| Ex. 7 | J | Nylon + Indium Tin Oxide | $1 \times 10^7$ | Acrylic + Nickel plating | $1 \times 10^7$ | A | A+ | Not observed |
| Ex. 8 | K | Nylon + Indium Tin Oxide | $5 \times 10^{11}$ | Acrylic + Nickel plating | $1 \times 10^7$ | B | B | Partially observed |
| Ex. 9 | L | Nylon + Indium Tin Oxide | $2 \times 10^3$ | Acrylic + Nickel plating | $1 \times 10^7$ | B | B | Partially observed |
| Ex. 10 | M | Nylon + Indium Tin Oxide | $1 \times 10^7$ | Acrylic + Nickel plating | $4 \times 10^{11}$ | B | B | Partially observed |
| Ex. 11 | N | Nylon + Indium Tin Oxide | $1 \times 10^7$ | Acrylic + Nickel plating | $6 \times 10^3$ | B | B | Partially observed |
| Ex. 12 | O | Nylon + Indium Tin Oxide | $1 \times 10^7$ | Acrylic + Poly hiophene coating | $2 \times 10^7$ | A | A | Not observed |
| Comp. Ex. 4 | P | Nylon + Indium Tin Oxide | $1 \times 10^7$ | — | — | C | C | — |

It is clear from these results that the intermediate transfer belts of the Examples provide excellent transfer performance onto paper having surface unevenness, prevents detachment of particles over an extended period of time, and has high durability.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. An intermediate transfer belt comprising:

a base layer;

an elastic layer over the base layer, the elastic layer containing spherical particles and having an uneven surface formed by the spherical particles; and a surface layer over the elastic layer, the surface layer containing at least one of antimony-doped tin oxide or indium tin oxide.

2. The intermediate transfer belt according to claim 1, wherein the surface layer has a surface resistivity of from $1\times10^4$ to $1\times10^{11}$Ω/□.

3. The intermediate transfer belt according to claim 1, wherein the spherical particles have a volume resistivity of from $1\times10^4$ to $1\times10^{11}$ Ω·cm.

4. The intermediate transfer belt according to claim 1, wherein the spherical particles comprise nickel.

5. The intermediate transfer belt according to claim 1, wherein the intermediate transfer belt is in the form of a seamless belt.

6. An image forming apparatus comprising:

an image bearer to bear a latent image;

a developing device to develop the latent image on the image bearer with toner to form a toner image;

the intermediate transfer belt according to claim 1 onto which the toner image is to be primarily transferred; and a transfer device to secondarily transfer the toner image from the intermediate transfer belt onto a recording medium.

7. The image forming apparatus according to claim 6, wherein the image bearer includes multiple image bearers disposed in series with each other, and the developing device includes multiple developing devices corresponding to the respective multiple image bearers.

* * * * *